US005176545A

United States Patent [19]

Brown

[11] Patent Number: 5,176,545

[45] Date of Patent: Jan. 5, 1993

[54] WIRE SAFETY CRIMP

[75] Inventor: Donald C. Brown, Freehold, N.J.

[73] Assignee: Heyco Stamped Products, Inc., Toms River, N.J.

[21] Appl. No.: 680,341

[22] Filed: Apr. 4, 1991

[51] Int. Cl.[5] ..... H01R 13/58

[52] U.S. Cl. ..... 439/885; 439/455

[58] Field of Search ..... 439/865, 885, 455, 606, 439/736

[56] References Cited

U.S. PATENT DOCUMENTS

| | | | |
|---|---|---|---|
| 3,030,694 | 4/1962 | Kerstetter et al. | 439/865 |
| 4,265,508 | 5/1981 | Chisholm | 439/885 |
| 4,266,844 | 5/1981 | Chelminski | 439/736 |
| 4,273,409 | 6/1981 | Blanche et al. | 439/736 |
| 4,310,213 | 1/1982 | Ketterolf, Sr. et al. | 439/455 |
| 4,428,642 | 1/1984 | Schwindt et al. | 439/885 |
| 4,556,275 | 12/1985 | Hamsher, Jr. | 439/736 |
| 4,718,865 | 1/1988 | Cordeiro | 430/606 |
| 4,790,776 | 12/1988 | Iijima | 439/695 |
| 4,854,894 | 8/1989 | Harrell | 439/606 |
| 4,897,046 | 1/1990 | Tengler et al. | 439/579 |
| 4,911,660 | 3/1990 | Alf et al. | 439/736 |
| 4,963,699 | 10/1990 | Urushibata et al. | 439/867 |
| 4,973,264 | 11/1990 | Kamono et al. | 439/498 |

*Primary Examiner*—Gary F. Paumen

*Attorney, Agent, or Firm*—Auslander & Thomas

[57] ABSTRACT

A progressive stamping strip for electrical parts is provided with a spaced away wire safety crimp. The stamping strip may be used to automatically crimp leads to both the electrical part and the wire safety crimp. The wire safety crimp is severed from the stamping strip separate from the electrical part. The wire safety crimp retains the wires together and retains them in the plug. The present invention provides an electrical part with a wire safety crimped on a lead, as well as a molded plug with the wires protected against exposure from the plug.

9 Claims, 2 Drawing Sheets

FIG. 1
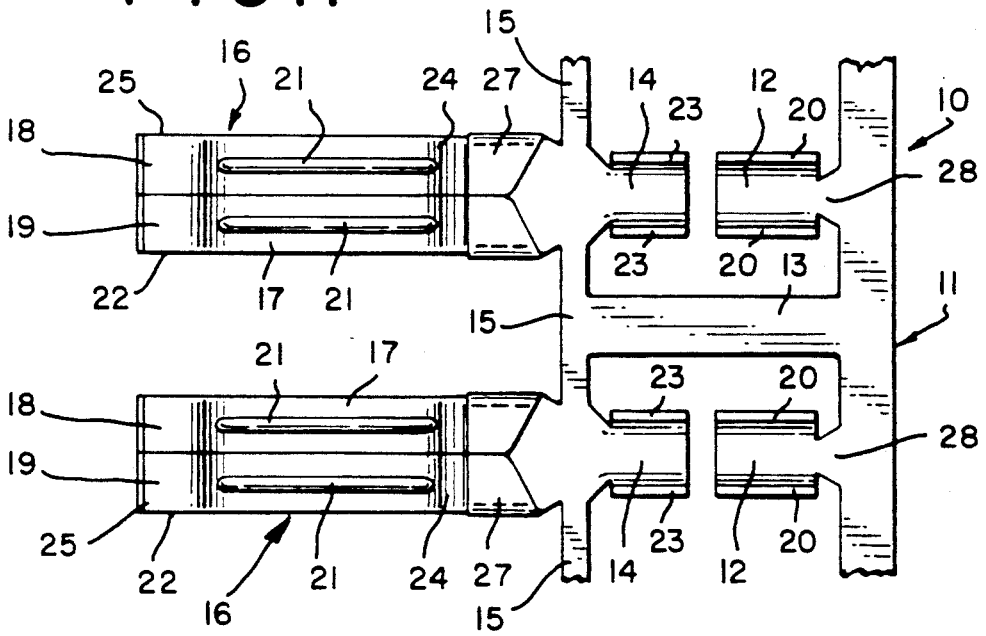
FIG. 2
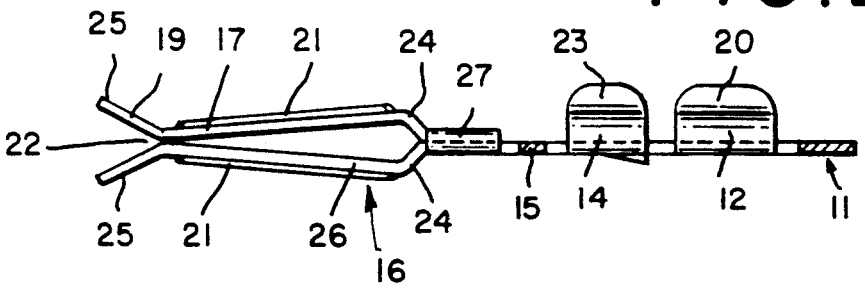
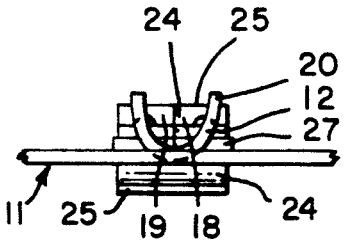
FIG. 3

FIG. 5
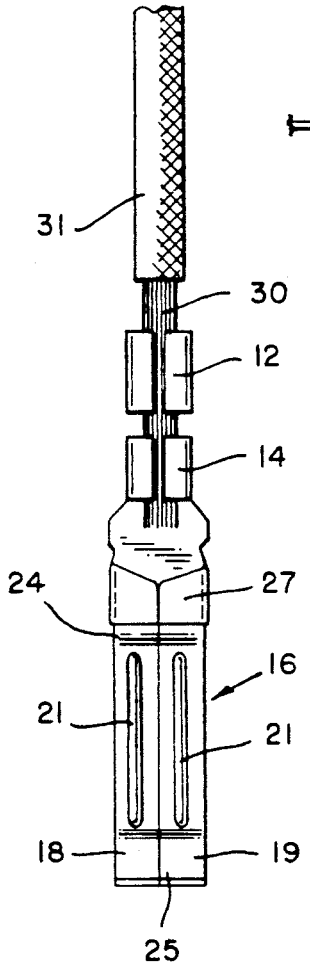
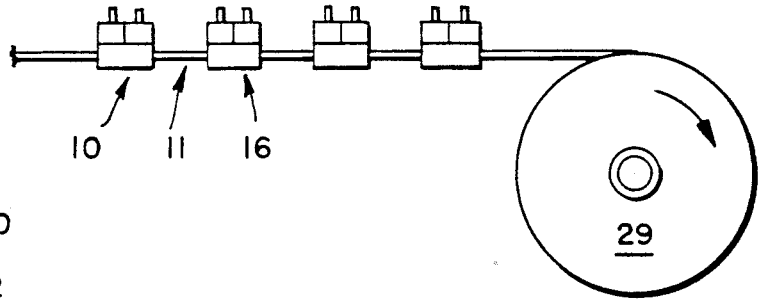
FIG. 4
FIG. 6
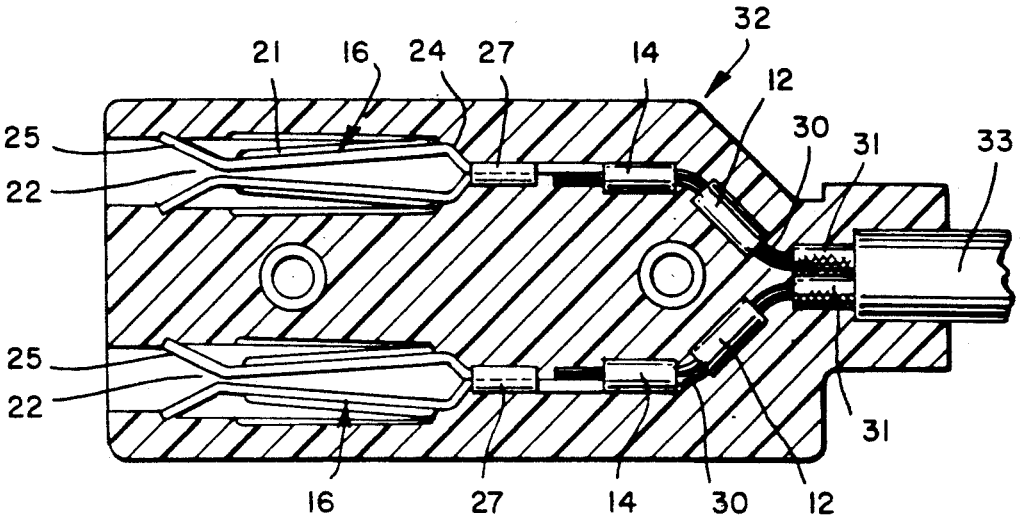

WIRE SAFETY CRIMP

BACKGROUND OF THE INVENTION

The present invention is a metal stamped wire safety crimp strain relief for an electrical part.

In the electrical industry it has been found very effective to be able to manufacture electrical parts in progressive stamping operations. A strip of metal can progressively pass through successive stamping steps to be formed into a desired electrical part. The electrical part can be left connected to the stamping strip. The stamping strip can then be used directly either off the original stamping machine or from a coil of attached stamped electrical parts and be fed into an automated crimping operation.

The progressive stamping operation alone provides many opportunities for economies. The art is well developed. Speed of production is one dividend of progressive stamping. Another dividend is that metal can be stamped to have strengths equivalent to solid electrical parts but economically produce effective metal electrical parts with less metal. Stamping also saves the cost of expensive manual labor. Progressive stamping enables automation of the making of the electrical parts.

Automated crimping has its foibles too. Wire can be crimped to electrical parts from a strip and be ready for further operations such as molding into plugs. The crimped wires can be placed in molds by automation also.

An important need for electrical parts connected to wires, leads, cord, and/or cables is wire safety and strain relief. The usability of electrical parts in plugs requires that wires provide electrical integrity and safety. Safety requires that the strands of wires are not likely to rip loose nor be exposed from plugs. Part of wire safety of connected electrical parts depends upon strain relief. The attaching crimp of the wire itself can protect the wire from strain in some measure. The molding of crimped electrical parts into a plug provides some further wire safety and strain relief. Wire safety and strain relief is always an important consideration in terms of integrity, cost and effectiveness of electrical parts and plugs.

Plugs on long cables are notoriously vulnerable to the temptation of being detached by a remote tug on the cable ultimately detaching wires and possibly exposing them. Such pulling is a great test for the best of wire safety systems and strain reliefs. The present invention provides a new and better, simple wire safety crimp. The creation of effective wire safety crimps and strain reliefs in a progressive stamping operation is very complex.

The present invention provides an effective efficient wire safety crimp on a stamping strip with a strain relief that can function in the environment of a progressive stamping operation, automated crimping and for use with molded plugs.

DESCRIPTION OF THE RELATED ART

The prior art discloses many different electrical parts crimped to wires, leads, cords and/or cables with various forms of strain reliefs and various molded plugs which by their configuration provide wire safety and strain relief.

U.S. Pat. No. 4,854,894 discloses a typical molded plug where the electric terminals are crimped to conductors. The electric cord extends centrally from the molded plug. In this configuration, there is some strain relief from a strain on the conductor, since strain must pass through the molded plastic of the plug to the spread apart terminals so that there is no direct strain on the conductor in the crimp of the terminal.

U.S. Pat. No. 4,790,776 discloses an molded plug similar the plug in U.S. Pat. No. 4,854,894. The blades are crimped to the conductors forming a V shaped separation in the plug so that strain has to be taken up by the molded plug. In FIG. 5(A) the terminal blades can be seen on a typical prior art stamping strip which can be used in the machine crimping of the blades to the conductors. The blade are firmly held to protect against their being ripped out and exposing wires.

U.S. Pat. No. 4,718,865 discloses a crimped electrical terminal blade with two crimpable portions on the blade. The second crimp provides a wire safety crimp for the attached conductor wire insulation. Both crimps are connected and extend from the blade. There is no flexibility as between the two crimps. The crimps are also aligned so that a linear tug on the conductor is in line with both crimps. The terminal and the conductor are in a separate housing which is then molded into the plug. The separation of the housing in the plug may provide some additional wire safety. The structure is complex and requires extra steps for assembly. U.S. Pat. No. 4,963,699, FIG. 4, discloses a somewhat similar wire holding configuration.

U.S. Pat. No. 4,273,409 discloses a two piece crimp on a conductor, crimping a wire, the crimp, having a double sided configuration, crimping the conductor wire flush to the back of a terminal tongue. This configuration does not provide any secondary wire safety but the wires are strongly protected by the single crimp.

U.S. Pat. No. 4,266,844 discloses an intricate system, including a double crimp within a ferrule sleeve 46 where conductor wires are spaced away from terminals by conductors 50, whose U shaped sections may serve as a strain relief within a plug. This is exemplary of the wire safety crimp and strain relief of enclosed electrical conductors and terminals within a plug configuration.

U.S. Pat. No. 4,973,264 discloses flat cable 50 in FIG. 2 in a non linear crimp configuration within a housing, functioning as a wire safety and strain relief in a single configuration.

U.S. Pat. No. 4,556,275 discloses a C shaped single, crimpable wire safety and strain relief for insulation in a housing. The parts are attached to each other.

U.S. Pat. No. 4,897,046 in FIG. 4, shows a molded wire safety 24.

SUMMARY OF THE INVENTION

The present invention is a stamped wire safety crimp for a conductor cable, lead, cord or wire, particularly for a lead wire molded in a plug. The wire safety crimp connects to either the conductor cable, lead, cord or wire and forms a wire safety crimp in the molded plug.

In a preferred embodiment, the present invention includes a continuous stamped strip of electrical parts, including a crimp for connecting an electrical part to a conductor wire and a wire safety crimp for the conductor cable, lead, cord or wire, preferably the wire. The wire safety crimp is spaced away and unconnected to the electrical part on the stamping strip, yet crimpable to the conductor cable, lead, cord or wire, particularly in a machine crimping operation.

The stamping strip of the present invention is made substantially in a prior art progressive stamping operation wherein metal electrical parts are progressively stamped and shaped. The stamped, shaped metal electrical parts are produced, joined on a metal stamping strip. The stamping strip of the present invention includes a longitudinal retaining strip with intermediate spaced away linking strips. The stamping strip, therefore, includes the electrical parts connected by integral, links between each part. The metal electrical parts include the conventional crimp with a spaced away, aligned crimpable portion, which may be simultaneously crimped to the conductor cable, lead, cord or wire in a machine crimping operation. The machine crimping operation strips off the connecting metal parts and provides the metal electrical part connected to the conductor wire, with a circumferential wire safety crimp on the conductor cable, lead, cord or wire, which may freely bend with the bends in the conductor wire.

In the manufacture of the continuous metal stamping strip, the completed electrical parts on the stamping strip are usually wound onto a reel, so that they can be available to be machine fed for an automated crimping operation.

Once the conductor cable, lead, cord or wire has been crimped with its metal wire safety crimp, the conductor cable may then be molded into a plug for use.

In conventional molding, the molding of the plastic of the plug, in itself, acts somewhat as a wire safety crimp. Where there is a plurality of cords in a plug, the individual conductor cords or leads, generally coming from electrical cable, are separated within the plug, which generally forms a V shaped relationship as between the cable and the individual cords. Thus, flexure and strain on the cable in the prior art generally is indirect because of the angulation as between the strain on the cable and the position of the conductor wire.

In the present invention, the angulation is the same, but the wire safety crimp, holds all of the strands of the wire. The wire safety crimp is embedded in the molded plastic, and is strongly engaged in the plastic of the plug and strongly hold the wires so that even a loose strand is not likely to be able to be pulled out of the plug and exposed.

The simplicity of the structure and the simplicity and the strength of the wire safety crimp provide inexpensive, unexpected wire safety in the environment of the conventional, automated crimping wires and molding them into plugs.

According to the present invention a stamping strip for the progressive stamping of electrical parts for crimped engagement to an electrical lead in a plastic molded electric plug is provided. The stamping strip has an end strip extending along the length of the stamping strip. A wire safety crimp extends inward from the end strip. There is stamped electrical part in the stamping strip which includes a crimp end. The stamped electrical part crimp end and the wire safety crimp are aligned and spaced away from each other. There is a lateral spacer spaced away from the wire safety crimp and the stamped electrical part crimp end on the end strip. The lateral spacer extends inward from the end strip. A link extends from at least one of the stamped electrical parts. The lateral spacer integrally joins the end strip and the link. The crimp end when conductively crimped to an electrical lead and the wire safety crimp when crimped to the electrical lead are separate and spaced away from each other along said electrical lead when the end strip and the lateral spacer and the link are severed from the stamping strip.

The stamping strip may include a projection linking the wire safety crimp and the end strip. The wire safety crimp may be U shaped and the edges of the U may be tapered. The wire safety crimp and the crimp end both may be U shaped and the edges of the U's may be tapered. The stamping strip may include at least two wire safety crimp portions and electrical parts with crimp ends and also at least one link connecting the stamped electrical parts and at least one lateral spacer connecting the link.

The present invention includes the combined stamped electrical part, a wire safety crimp part and an electrical lead, all for molding into an electric plug. The stamped electrical part including the crimp end is crimped to the safety wire electrical lead. The wire safety crimp part is crimped near the crimp end, separate and spaced away from the crimp end. The wire safety crimp part is separately engaged by the molding plastic when molded in a plug to retain the electrical lead conductor wire in the plug. The uncrimped wire safety crimp part may be U shaped and the edges of the U may be tapered.

The present invention includes a molded plastic electric plug with a plastic body, at least one stamped electrical part, at least one wire safety crimp part, and at least one electrical lead. At least one stamped electrical part includes a crimp end, crimped to the conductor of at least one electrical lead. At least one wire safety crimp part is crimped to at least one electric lead near a crimp end. The wire safety crimp is spaced away from at least one crimp end is separate and engaged by the molding plastic of the plug so that the wire safety crimp part retains the conductor wire in the plug. At least one uncrimped wire safety crimp part may be U shaped and tapered.

Although such novel feature or features believed to be characteristic of the invention are pointed out in the claims, the invention and the manner in which it may be carried out, may be further understood by reference to the description following and the accompanying drawing.

BRIEF DESCRIPTION OF THE DRAWING

FIG. 1 is a broken away plan view of a stamping strip including a metal wire safety crimp of the present invention.

FIG. 2 is a side elevation of FIG. 1.

FIG. 3 is a right end elevation of a single electrical part of FIG. 1.

FIG. 4 is a schematic of a stamping strip, such as shown in FIG. 1, being taken up on a reel.

FIG. 5 is a plan view of an electrical part, such as shown in FIGS. 1 through 3, crimped onto a conductor wire.

FIG. 6 is a section through a molded plastic plug, including two crimped electrical parts of FIG. 5.

Referring now to the figures in greater detail, where like reference numbers denote like parts in the various figures.

DESCRIPTION OF THE PREFERRED EMBODIMENTS

The stamping strip 10 has an end strip 11, from which extends shaped wire safety crimps 12. Between the wire safety crimps 12 on the end strip 11 is a cross piece 13, which joins the electrical part link strip 15 to the end strip 11. The link strip 15 joins the electrical part female receptacles 16, which are attached to the stamping strip 10. As can be seen in FIG. 1, the female receptacles have crimp ends 14, a first leg 17 has a first fold 18 and a second fold 19. There is a second leg 26.

The first and second folds 18, 19 are integrally joined to the second leg at fold lines 27.

The wire safety crimp 12 extends from a projection 28 on the end strip 11.

As can be seen in FIG. 3, the wire safety crimp 12 has a U shaped configuration with tapered edges 20.

The first leg 17 and second leg 26 are rigidized by spines 21 stamped into the legs 17 and 26. In the female receptacle 16, exemplified in the drawings, the female receptacle 16 has flared end 22. The crimp end 14 of the female receptacle 16 is U shaped with a tapered crimp end 23, similar to the crimp end 20 on the wire safety crimp 12.

The female receptacle 16 has cambered portions 24, spacing the legs 17 and 26 apart, so that they can join in spring like engagement at the flared end 22. The flared end 22 comprises leg ends 25 on the legs 17 and 26, forming a V shape to guide a male electrical part into electrical contact when in use.

In FIG. 4, female receptacles 16 are seen being wound up on a reel 29, as they come off a stamping machine.

In FIG. 5, a female receptacle 16 is shown, having been stamped and crimped to a strip wire 30 from a cord 31 in a cable 33.

As shown in FIG. 5, the female receptacle 16, is shown after passing through an automated stamping and crimping operation. The ends of the link strip 15 are severed and the tapered crimp edges 20 and 23 are stamp crimped and curled around the wire 30. As can be seen, the crimp 14 is connected to the wire 30, while the wire safety crimp 12 is spaced away on the wire 30, firmly crimping and holding the wire 30, but flexible to movement of the wire 30.

As shown in FIG. 6, the two female receptacles 16 are molded into a plastic plug 32. Two cords 31 extend from a cable 33. The wires 30 are crimped to crimp ends 14. The wire safety crimp 12 are also crimped to the wire 30. The female receptacles 16 are spaced apart, positioned to normally receive the electrical male connector (not shown). As can be seen, the spacing apart necessitates the cord 31 with the wires 30 and the wire safety crimp 12, to form a V shape.

OPERATION

The stamping strip 10 is typical of a progressive stamping and folding operation for the manufacture of electrical parts. The female receptacle 16 is a typical stamped and folded electrical part made by a progressive stamping operation. In FIG. 1, the electrical part is a female receptacle 16 with a crimp end 14. No novelty is claimed or suggested with regard to the structure of the receptacle 16 with its crimp end 14.

In the manufacture of electric plugs, for instance, a common procedure is to take a strip of electrical parts held together on a stamping strip 10, generally on an end strip 11, wound up on a reel 29, and then feed the stamping strip 10 into an automated crimping operation, which separates the electrical parts, stamps off the linking parts and crimps the electrical parts to wires, such as shown in FIG. 5. The crimped electrical parts are attached to the wires forming cord sets, which are then placed into plastic molds for the formation of plugs, such as plug 32, as shown in FIG. 6.

The present invention spaces apart on the conventional stamping strip 10, a wire safety crimp 12. The wire safety crimp 12 extends from the stamping strip 10 on a projection 28.

In a usual stamping and crimping operation, wires 30 are automatically placed in crimps ends 14 and wires 30, or the insulated cord 31 is placed in the wire safety crimp 12, and linking end strip 11, projection 28 cross piece 13 and linking strip 15 are severed from the stamping set and the crimp end 14 and the wire safety crimp 12 are crimped. A clean electrical part, such as shown in FIG. 5, results from this operation.

The stamping strip 10 has cross pieces 13 joining the end strip with the linking strip 15. Thus, in the stamping operation, the laid wire 30 is simultaneously joined to the spaced apart crimps 12 and 14, which are now independent of each other.

In the prior art, among other things, double crimps have been provided to provide wire safety. Such crimps generally are connected to each other, one of which commonly is crimped to the wire and the other crimped to the wire or wire insulation to act as a wire safety. Typical of such devices is the double crimp, as shown in U.S. Pat. No. 4,718,865. While double crimps are effective in providing wire safety, they are necessarily joined to each other and inflexible. The joined double crimp has the advantage of being easily adapted to a machine crimping operation, but the linkage between the two crimps generally renders them inflexible.

The molding of a crimped wire with just a single crimp, similar to the molding of a wire in a plug, such as shown in FIG. 6, does provide some degree of wire safety with the plastic of the plug also holding the wire and/or the wire insulation in the grasp of the molded plastic. When more than one conductor cord 31 is molded into a plug 32, the wires are generally separated, as shown in FIG. 6, so that a normal tug on a cable would be directed through an angulated wire before straining the actual wire to electrical part connection.

The present invention, by having a separated wire safety crimp, has the advantage of being able to use the natural flexibility of the wire between the crimps. There is no linkage between the two crimps. Therefore, when molded into a plug 32, such as shown in FIG. 6, the conductor wire 30 and the cord 31 are easily bent, and strongly held together by the wire safety crimp 12, so that the strain relief crimp 12 in this type of usage is not in linear alignment with the wire crimped 30 crimped to the crimp end 14. Thus, the angulation of the wire alone provides an extra modicum of strain relief. The cord 31 in effect may be a lead including insulation and a wire 30.

The bulk of the wire safety crimp 12, in this instance, angulated away from the crimp 14, also serves to be grasped by the plastic in the plug 32. All strain must necessarily pass through the wire safety crimp 12 first, which is crimped to and engages all the wire strands, so that no basic weakness in the strands themselves is likely to give under the strain nor are broken or loose strands of wire likely to be pulled out of the body of the plug 32 and exposed. The bulk of the wire safety crimp 12 also provides extra strain relief because of its engagement in the plastic.

The present invention provides an inexpensive, non bulky, effective, flexible wire safety, not heretofore available in the spaced apart relationship, which enables it to also be machine crimped.

The terms and expression which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A stamping strip for the progressive stamping of metal electrical crimpable parts for attaching to an electrical lead including a conductor portion in a plastic molded electric plug, said stamping strip including, an end strip, said end strip at the outer periphery of said stamping strip, said end strip extending longitudinally along the length of said stamping strip, a stamped metal electrical lead safety crimp portion for attachment to said electrical lead, said stamped metal electrical lead safety crimp portion extending inward from said end strip, a spacer portion, said spacer portion having a first and second end, said first end of said spacer portion at said end strip, said spacer portion along its length spaced away from said stamped metal electrical lead safety crimp portion, a link portion, said link portion extending from said second end of said spacer portion, a stamped metal electrical part for attachment to said electrical conductor portion of said electrical lead, said stamped metal electrical part including a body and a crimp end, said link portion linked to said stamped metal electrical part between said crimp end and said body, said crimp end separate from and spaced away from said stamped metal electrical lead safety crimp portion, and said crimp end further aligned with said stamped metal electrical lead safety crimp portion, whereby said crimp end when crimped to said conductor portion of said electrical lead and said stamped metal electrical lead safety crimp portion when crimped to said electrical lead when said end strip and said spacer portion and said link portion are severed from said stamping strip are separate and spaced away from each other along said electrical lead.

2. The invention of claim 1 including a projection linking said stamped metal electric lead safety crimp portion to said end strip.

3. The invention of claim 1 wherein said stamped metal electric lead safety crimp portion is U shaped.

4. The invention of claim 3 wherein the edges of said U are tapered.

5. The invention of claim 1 wherein said crimp end is U shaped.

6. The invention of claim 5 wherein the edges of said U are tapered.

7. The invention of claim 1 wherein said stamped metal electric lead safety crimp portion and said crimp end are U shaped.

8. The invention of claim 7 wherein the edges of said U-shapes are tapered.

9. The invention of claim 1 wherein said stamping strip includes at least two stamped metal electrical lead safety crimp portions; at least two stamped metal electrical parts including crimp ends; and at least one spacer portion, said at least one spacer portion joining at least one link portion, and said at least one link portion joining at least two said stamped metal electrical parts.

* * * * *